US008649528B2

(12) United States Patent
Fürst et al.

(10) Patent No.: US 8,649,528 B2
(45) Date of Patent: Feb. 11, 2014

(54) MICROPHONE UNIT WITH INTERNAL A/D CONVERTER

(75) Inventors: Claus Erdmann Fürst, Roskilde (DK); Igor Mucha, Bratislava (SK); Lars Stenberg, Roskilde (DK)

(73) Assignee: Techtronic A/S, Roskilde (DK)

( * ) Notice: Subject to any disclaimer, the term of this patent is extended or adjusted under 35 U.S.C. 154(b) by 120 days.

(21) Appl. No.: 12/929,079

(22) Filed: Dec. 29, 2010

(65) Prior Publication Data

US 2011/0096945 A1 Apr. 28, 2011

Related U.S. Application Data

(63) Continuation of application No. 09/964,893, filed on Sep. 28, 2001, now abandoned.

(60) Provisional application No. 60/266,176, filed on Feb. 2, 2001.

(51) Int. Cl.
*H04R 1/02* (2006.01)
*H04R 3/00* (2006.01)

(52) U.S. Cl.
USPC ..... 381/91; 381/122; 381/113; 381/115; 330/10; 330/251

(58) Field of Classification Search
USPC ..... 381/60, 91, 92, 122, 312, 111–115, 381/369, 355; 330/10, 251, 207 A
See application file for complete search history.

(56) References Cited

U.S. PATENT DOCUMENTS 4,689,820 A 8/1987 Kopke et al.
4,993,072 A 2/1991 Murphy
5,051,799 A 9/1991 Paul et al.
5,144,308 A 9/1992 Norsworthy
5,212,764 A 5/1993 Ariyoshi
5,276,739 A 1/1994 Krokstad et al.
5,339,285 A 8/1994 Straw
5,402,496 A 3/1995 Soli et al.

(Continued)

FOREIGN PATENT DOCUMENTS

DE 199 18 883 11/2000
EP 0835014 4/1998

(Continued)

OTHER PUBLICATIONS

Japanese Office Action dated Feb. 8, 2011 issued in corresponding Japanese Application No. 2001-174543 and partial English translation thereof.

(Continued)

*Primary Examiner* — Xu Mei

(74) *Attorney, Agent, or Firm* — Harness, Dickey & Pierce, P.L.C.

(57) ABSTRACT

The present invention relates to a microphone assembly comprising a microphone assembly casing having a sound inlet port and a transducer for receiving acoustic waves through the sound inlet port. The transducer converts the received acoustic waves to analog audio signals. The assembly according to the present invention further comprises an electronic circuit positioned within the microphone assembly casing, said electronic circuit comprising a pre-amplifier and an analog-to-digital converter preferably in form of a sigma-delta modulator so as to convert amplified analog audio signals to digital audio signals.

8 Claims, 3 Drawing Sheets

(56) References Cited

U.S. PATENT DOCUMENTS

| | | | | |
|---|---|---|---|---|
| 5,577,129 | A | 11/1996 | Ehara | |
| 5,654,984 | A | 8/1997 | Hershbarger et al. | |
| 5,708,720 | A | 1/1998 | Meyer | |
| 5,757,933 | A | 5/1998 | Preves et al. | |
| 5,796,848 | A | 8/1998 | Martin | |
| 6,052,437 | A | 4/2000 | Kunisch et al. | |
| 6,104,821 | A | 8/2000 | Husung | |
| 6,160,450 | A | 12/2000 | Eschauzier et al. | |
| 6,167,258 | A | 12/2000 | Schmidt et al. | |
| 6,421,448 | B1 | 7/2002 | Arndt et al. | |
| 7,928,876 | B2 * | 4/2011 | Thomsen et al. | 341/143 |
| 2010/0063824 | A1 * | 3/2010 | Iwata | 704/500 |

FOREIGN PATENT DOCUMENTS

| | | | |
|---|---|---|---|
| EP | 0848573 | | 6/1998 |
| EP | 1 052 880 | A2 | 11/2000 |
| EP | 1 304 016 | B1 | 9/2004 |
| EP | 1 364 555 | B1 | 5/2005 |
| GB | 2319922 | A | 6/1998 |
| JP | 61-257100 | A | 11/1986 |
| JP | 4097698 | A | 3/1992 |
| JP | 5-160736 | | 6/1993 |
| JP | 6318872 | A | 11/1994 |
| JP | 07-093582 | | 4/1995 |
| JP | 08-018457 | A | 1/1996 |
| JP | 08-162961 | | 6/1996 |
| JP | 08-168091 | A | 6/1996 |
| JP | 8162961 | A | 6/1996 |
| JP | 2734265 | | 3/1998 |
| JP | 10-0145232 | A | 5/1998 |
| JP | 10-155234 | A | 6/1998 |
| JP | 10322214 | A | 12/1998 |
| JP | 11017549 | A | 1/1999 |
| JP | 2000-0174627 | A | 6/2000 |
| JP | 2000-0224690 | A | 8/2000 |
| JP | 2002-0224690 | A | 8/2000 |
| WO | WO 95/22879 | | 8/1995 |
| WO | WO 95/022879 | | 8/1995 |

OTHER PUBLICATIONS

International Preliminary Examination Report dated May 23, 2003 for International Appl. No. PCT/DK02/00076.

PCT Written Opinion dated Mar. 24, 2003 for International Appl. No. PCT/DK02/00076.3.

EPO Summons to attend oral proceedings pursuant to Rule 115(1) EPC issued in corresponding European Application No. 02710759.8, dated Oct. 19, 2011.

Japanese Office Action dated May 17, 2011 in corresponding Application No. 2001-174543.

TCL320AD58C, "Sigma-Delta Stereo Analog-to-Digital Converter," Texas Instruments Product Information, Nov. 1995.

"Silicon-dioxide electret transducer", D. Hohm 1984 et al., *J. Acoust. Soc. Am.,* 75(4), pp. 1297-1298, 1984.

"Smart Sensor Interface with A/D Conversion and Programmable Calibration", P. Malcovati et al.,*IEEE—Journal of Solid State Circuits,* vol. 29, No. 8, pp. 963-966, Aug. 1994.

Office Action dated Nov. 13, 2012 issued in Japanese Application No. 2011-203303 (with partial English translation).

Partial English translation of Japanese Office Action mailed Jun. 11, 2013, issued in Japanese Patent Application No. 2011-203303.

Office Action dated Aug. 31, 2010 in corresponding Japanese Application No. 2001-174543, with partial English translation.

Bertan Bakkaloglu et al., "A Voice-Band Audio Processor IC for CDMA Applications," IEEE, 1999, pp. 484-487.

TLC320AD58C, "Sigma-Delta Stereo Analog-to-Digital Converter," Texas Instruments Product Information, Nov. 1995.

H. Neuteboom et al., "A Single Battery, 0.9V-Operated Digital Sound Processing IC Including AD/DA and IR Receiver with 2mW Power Consumption," Paper TP 6.4, IEEE International Solid-State Circuits Conference, 1997 (ISSCC97).

European Patent Office, Notice of Opposition dated Feb. 6, 2006, mailed by the European Patent office on Mar. 1, 2006.

"A basic concept of direct converting digital microphone", Yoshinobu Yasuno et al., *J. Accoust. Soc. Am.*, 106 (6), pp. 3335-3339, Dec. 1999.

"Battery Supplied Low Power Analog-Digital Front-End for Audio Applications", R. Klootsema et al.

"Microfabricated Thermal Absolute-Pressure Sensor with On-Chip Digital Front-End Processor", Carlos H. Mastrangelo et al., *IEEE Journal of Solid-State Circuits*, vol. 26, No. 12, pp. 1998-2007, Dec. 1991.

"Silicon-dioxide electret transducer", D. Hohm et al., *J. Acoust. Soc. Am.*, 75(4), pp. 1297-1298, 1984.

"Multi-purpose interface for sensor systems fabricated by CMOS technology with post-processing", Carlos Azeredo Leme et al., *Sensors and Actuators*, 77-81 (1993).

"A Monolithic Surface Micromachined Accelerometer with Digital Output", Crist Lu et al., *IEEE International Solid-State Circuits Conference*, Session 9, Paper TA9.4, pp. 160-161, 1995.

"Design and Test of a Precision Servoaccelerometer with Digital Output", Y. de Coulon et al., The $7^{th}$ International Conference on Solid-State and Actuators, pp. 832-835.

"Smart Sensor Interface with A/D Conversion and Programmable Calibration", P. Malcovati et al., *IEEE—Journal of Solid-State Circuits*, vol. 29, No. 8, pp. 963-966, Aug. 1994.

*EMC for Product Designers*, Tim Williams, 1992.

"An adaptive microphone array processing system", E.M. Dowling et al., pp. 507-516, 1992.

"Optical direct analog-to-digital conversion for microphones", Hitoshi Mada et al., *Applied Optics*, vol. 22, p. 3411, Nov. 1, 1983.

International Search Report for International Application No. PCT/DK02/00076, Jul. 7, 2002.

* cited by examiner

MICROPHONE UNIT WITH INTERNAL A/D CONVERTER

This application is a continuation application of U.S. application Ser. No. 09/964,893, filed on Sep. 28, 2001 now abandoned (published as United States Publication No. 2002/0106091, on Aug. 8, 2002), which claims priority under 35 U.S.C. §120 of U.S. Provisional Application No. 60/266,176 filed on Feb. 2, 2001, the contents of each of which are incorporated herein by reference in their entirety.

FIELD OF INVENTION

The present invention relates to a microphone assembly and, in particular, to a microphone assembly comprising a transducer, a pre-amplifier and an analog-to-digital (A/D) converter in the housing of the microphone assembly.

BACKGROUND OF THE INVENTION

Currently, a typical microphone assembly used in portable phones (e.g., mobile or cellular phones) converts acoustical signals to analog audio signals, which are transmitted from the microphone assembly along a signal line to an external A/D converter for digitization. As the analog audio signals travel from the microphone assembly to the A/D converter, however, they are undesirably susceptible to electromagnetic interference (EMI) caused by the presence of high frequency signals (normally around 1-2 GHz). To reduce the effects of EMI, the current practice in the mobile phone industry is to use external capacitors to de-couple the high frequency signal to "clean" the analog audio signals before digitization. After digitization, the resulting digital output signals are largely insensitive to EMI. Accordingly, it is desirable to convert the acoustical signals to digital output signals as soon as possible to prevent EMI from degrading signal integrity.

Further, different microphone assemblies currently used in portable phones have different sensitivity levels and output impedances. Thus, portable phones are typically designed with only one type of microphone assembly in mind, and the microphone pre-amplifier drive levels are set in accordance with the output characteristics of the particular microphone assembly. It is not practical, therefore, to substitute one microphone assembly for another because the gain of the microphone pre-amplifier would have to be adjusted to accommodate a different microphone assembly with a different output characteristic from that of the original microphone assembly. Thus, a hardware modification or an analog level adjustment of the microphone sensitivity is typically needed to switch one type of microphone for another.

U.S. Pat. No. 5,796,848 discloses a digital hearing aid with a microphone. In order to avoid EMI an A/D converter is positioned within the microphone casing whereby the A/D converter is shielded against EMI. The solution suggested in U.S. Pat. No. 5,796,848 reduces the influence of EMI, but due to a small opening in the casing, which is necessary so as to allow acoustic signals to be sensed by the microphone positioned inside the casing, EMI may still influence signal processing.

Electrical connections to the assembly such as power supply and input/output interfaces may also be sources of introducing EMI into the assembly. Even though digital input and output connections are very insensitive to EMI they may act as carriers/antennas so that EMI is introduced to the otherwise shielded microphone assembly. As described in U.S. Pat. No. 5,796,848 power supply lines are de-coupled against EMI by adding external capacitors to the powers supply line.

However, the digital interface can not be de-coupled effectively against EMI applying such capacitors.

Therefore, there exists a need for a microphone assembly that shields analog audio signals against the effects of EMI without the use of de-coupling capacitors and that provides enhanced interchangeability. It is an object of the present invention to provide such microphone assembly.

SUMMARY OF THE INVENTION

The above-mentioned object is provided in a first aspect of the present invention by providing a microphone assembly comprising

- a microphone assembly casing having a sound inlet port,
- a transducer for receiving acoustic waves through the sound inlet port, and for converting received acoustic waves to analog audio signals, said transducer being positioned within the microphone assembly casing,
- an electronic circuit positioned within the microphone assembly casing, said electronic circuit comprising
  - a pre-amplifier having an input and an output terminal, the input terminal being connected to the transducer so as to receive analog audio signals from the transducer, and
  - an analog-to-digital converter having an input and an output terminal, the input terminal being connected to the output terminal of the pre-amplifier so as to receive amplified analog audio signals from the pre-amplifier and to convert said amplified analog audio signals to digital audio signals.

In order to protect against EMI the microphone assembly casing may be a metallic housing or a housing holding a metallic coating or metallic layer so as to establish a Faraday cage. Preferably, the analog-to-digital converter comprises a sigma-delta modulator. In addition, the microphone assembly may further comprise filter means between the pre-amplifier and the sigma-delta modulator so as to filter amplified analog audio signals. This filter means may comprise a high-pass filter implemented as a pure high-pass filter or, alternatively, as a band-pass filter implemented as a high-pass filter and a low-pass filter in combination.

The microphone assembly may in addition comprise a second amplifier between the filter means and the sigma-delta modulator so as to amplify the filtered analog audio signals, In order to save space, reduce cost and to minimize exposure of analog signal path's to EMI the pre-amplifier and the sigma-delta modulator are preferably integrated on a chip so as to form an integrated circuit. Such chip may be implemented monolithically so as to form an ASIC. In case the microphone assembly also comprises a high-pass filter, the pre-amplifier, the sigma-delta modulator, and at least part of the high-pass filter may advantageously be integrated on the same chip so as to form a monolithic integrated circuit. Typically, the high-pass filter comprises a resistor and a capacitor, which in combination alone or in combination with other components forms the high-pass filter. The capacitor part of such high-pass filter may advantageously be physically separated from the resistor part. The second amplifier may also form part of the integrated circuit further comprising the pre-amplifier, the filter means and the sigma-delta modulator. The second amplifier may be implemented as e.g. a buffer or a differential converter, such as a single-entity differential converter.

Alternatively, the pre-amplifier, the sigma-delta modulator, and at least part of the high-pass filter may be implemented on separate chips so as to form separate electronic circuits.

Typically, the transducer comprises a flexible diaphragm having a pressure-equalizing opening penetrating the diaphragm. This pressure equalizing opening has dimensions so that frequencies in the analog audio signals below a predetermined frequency value are suppressed. Generally speaking, by making the pressure equalizing opening smaller, the cut-off frequency of the acoustic high-pass filter decreases. With a lower cut-off frequency of the acoustic high-pass filter the electronic high-pass filter can be designed with a smaller capacitor without increasing the total noise from the microphone. This design route is of specific importance in the area of hearing aids where space issues within hearing instruments are among the most important design parameters.

The microphone assembly may further comprise a digital filter connected to the output terminal of the sigma-delta modulator. Preferably, the digital filter is a digital decimation low-pass filter forming part of the integrated circuit.

The microphone assembly may further comprise a low-pass filter between the pre-amplifier and the analog-to-digital converter so as to low-pass filter amplified analog audio signals to avoid aliasing during the sampling process.

In a second aspect, the present invention relates to a portable unit comprising a microphone assembly according to the first aspect of the present invention, said microphone assembly being connected to digital signal processing means (e.g. a DSP) for further signal processing.

Since the signal processing outside the microphone assembly is purely digital, the DSP used for the further signal processing is denoted a pure DSP or a pure digital DSP.

The portable unit may be selected from the group consisting of hearing aids, assistive listening devices, mobile recording units, such as MP3 players; and mobile communication units, such as mobile or cellular phones.

In a third aspect, the present invention relates to a method of processing received acoustical signals, said method comprising the steps of receiving acoustical signals within a microphone casing, converting the received acoustical signals to analog audio signals within the microphone casing, amplifying the converted analog audio signals within the microphone casing, and converting the amplified analog audio signals to digital audio signals within the microphone casing.

The method may further comprise a step of filtering the amplified analog audio signals prior to converting the converted analog audio signals to digital audio signals. The filtering step may comprise high-pass filtering of the amplified analog audio signals.

The method may further comprise a step of digitally processing the digital audio signals. This processing step may comprise the step of filtering the digital audio signals. Finally, the method may further comprise a step of transmitting the digital audio signals (filtered or not filtered) to a DSP for further processing. This DSP may be positioned in- or outside the microphone casing.

In a fourth and final aspect, the present invention relates to a microphone assembly comprising a microphone assembly casing having a first and a second sound inlet port, a first transducer for receiving acoustic waves through the first sound inlet port, and for converting received acoustic waves to analog audio signals, said first transducer being positioned within the microphone assembly casing, a second transducer for receiving acoustic waves through the second sound inlet port, and for converting received acoustic waves to analog audio signals, said second transducer being positioned within the microphone assembly casing, an integrated circuit positioned within the microphone assembly casing, said integrated circuit comprising a pre-amplifier module having input and output terminals, a first input terminal being connected to the first transducer, a second input terminal being connected to the second transducer and an analog-to-digital converter module having input and output terminals, a first input terminal being connected to a first output terminal of the pre-amplifier, a second input terminal being connected to a second output terminal of the pre-amplifier.

The pre-amplifier module may comprise a first and a second pre-amplifier—i.e. a pre-amplifier for each of the transducers. The analog-to-digital converter module may comprise a first and a second sigma-delta modulator, the first sigma-delta modulator being connected to the first pre-amplifier, the second sigma-delta modulator being connected to the second pre-amplifier.

The microphone assembly according to the fourth aspect of the present invention may further comprise a first high-pass filter between the first pre-amplifier and the first sigma-delta modulator, and a second high-pass filter between the second pre-amplifier and the second sigma-delta modulator. This high-pass filter may at least partly be integrated with the integrated circuit.

The microphone assembly may further comprise an analog beam forming circuitry in a configuration where a plurality of transducers and pre-amplifiers are connected to said analog beam forming circuitry so as to perform beam forming in the analog domain. The output signal from the beam forming circuitry is provided to one or more sigma-delta modulators and thereby converted to the digital domain. The beam forming circuitry may be implemented as a time continuous analog circuitry or as a time discrete analog circuitry—e.g. switched capacitor.

Alternatively, beam forming may be performed in the digital domain using a configuration where a plurality of transducers, pre-amplifiers, filters and sigma-delta modulators are interconnected. Each of the sigma-delta modulators is connected to a digital beam forming circuitry. A digital decimation filter may be connected to the beam forming circuitry so as to filter the output signal from the beam forming circuitry. Alternatively, decimation filters may be connected between each of the sigma-delta modulators and the beam forming circuitry.

The inventive combination of the microphone having an internal A/D converter and optionally a pure DSP overcomes several aforementioned disadvantages associated with prior art systems in which DSPs have analog processing capability. By having microphones with digital output that is transmitted from the microphone casing, the inventive microphones promote interchangeability, permitting one microphone assembly to be easily substituted for another. Any adjustments that may be required can be entirely software controlled.

In addition, the use of a pure DSP simplifies the design of a mobile phone and lowers manufacturing costs because pure DSPs are less expensive to manufacture compared to DSPs which also contain analog circuitry.

BRIEF DESCRIPTION OF THE DRAWINGS

The foregoing and other advantages of the invention will become apparent upon reading the following detailed description and upon reference to the following drawings, where.

Figure 1:
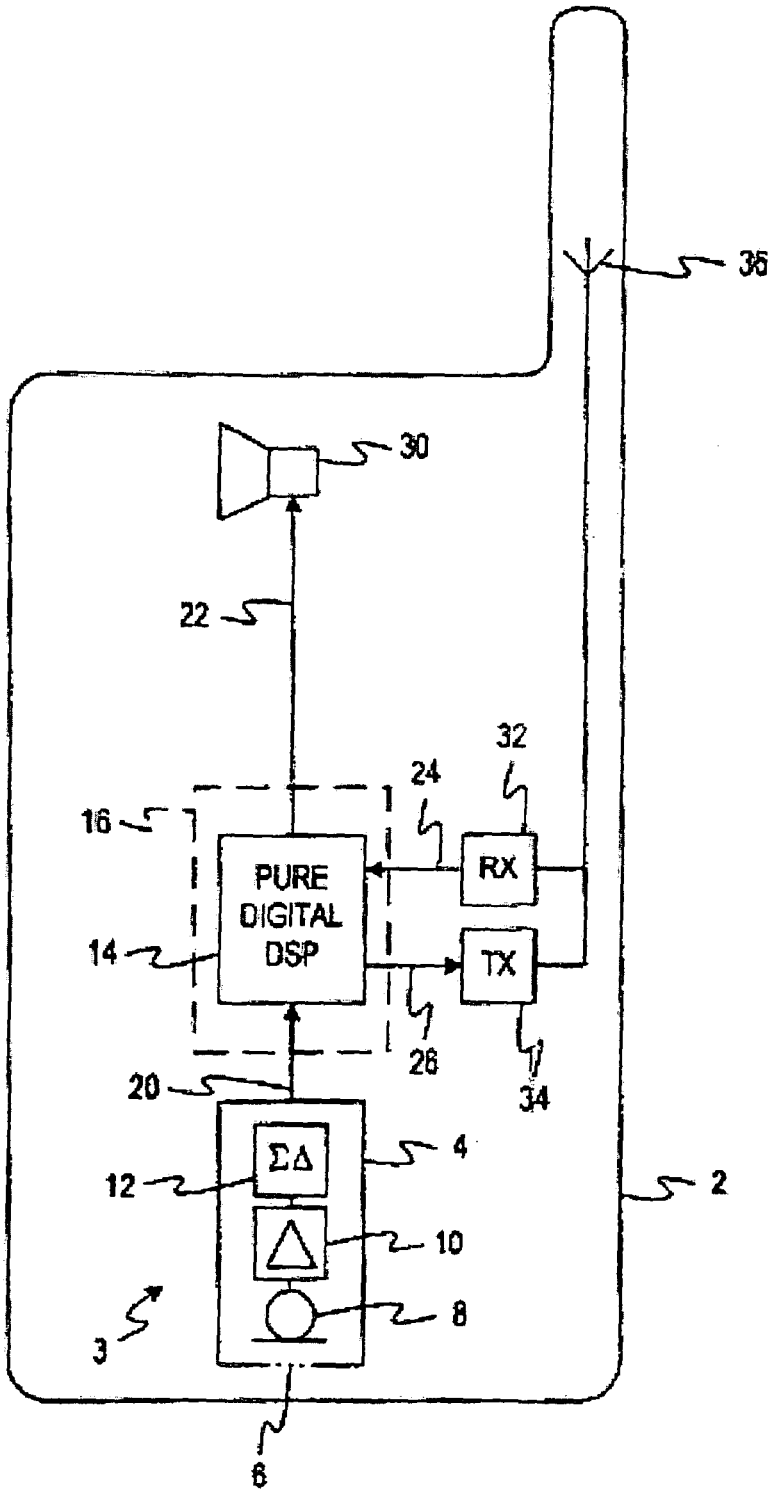
FIG. 1 is a functional diagram of a mobile phone in accordance with a preferred embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

FIG. 1 shows a first example of use of the microphone assembly according to the first aspect of the present invention.

A mobile phone 2 shown in FIG. 1 generally includes a microphone assembly 3, a pure digital signal processor (pure digital DSP) 14, a speaker assembly 30, an RF receiver unit 32, an RF transmitter unit 34, and an antenna 36. The microphone assembly 3 comprises a microphone assembly casing 4 that houses transducer 8, microphone pre-amplifier 10, and analog-to-digital (A/D) converter 12. In addition to providing structural integrity to the entire microphone assembly 3, the microphone assembly casing 4 shields or protects transducer 8, microphone pre-amplifier 10, and A/D converter 12 against undesired high frequency EMI. The microphone assembly casing 4 is preferably composed of an electrically conducting material, such as steel or aluminum, or metallized non-conductive materials, such as metal particle-coated plastics.

Acoustical energy is received through sound inlet 6 by transducer 8. In a preferred embodiment, transducer 8 comprises an electret assembly that includes a flexible diaphragm that moves in response to exposure to acoustical energy. The movement of the flexible diaphragm results in an electrical signal and, thus, transducer 8 transduces the acoustical energy into electrical energy. This electrical energy is provided as analog audio signals to microphone pre-amplifier 10, which amplifies the analog audio signals to an appropriate level for A/D converter 12. Pre-amplifier 10 may include more than one gain stage. A/D converter 12 converts the analog audio signals to digital output signals.

In a preferred embodiment, A/D converter 12 is implemented as a sigma-delta modulator, which converts the analog audio signals into a serial digital bit stream. Alternatively, A/D converter 12 may be, for example, a flash or pipeline converter, a successive approximation converter, or any other suitable A/D converter. The serial digital bit stream may be transmitted on line 20 to pure digital DSP 14 for further processing. Pure digital DSP 14 does not contain analog circuitry and does not process analog signals. Rather, the pure digital DSP 14 only contains digital circuitry (circuitry that is adapted to only process digital signals) and only processes digital signals. Thus, the input signals on lines 20, 24 to and the output signals on lines 22, 26 from the pure digital DSP 14 are only in a digital format.

Pure digital DSP 14 processes the digital output signals from line 20 and provides digital signals for transmission on line 26 to the RF transmitter unit 34. The RF transmitter unit 34 converts the digital signals for transmission into RF signals, which are transmitted by the antenna 36. Similarly, the antenna 36 provides RF signals to the RF receiver unit 32, which provides received digital signals on line 24 to the pure digital DSP 14. The pure digital DSP 14 processes the received digital signals and provides digital audio output signals on line 22 to the speaker assembly 30. The digital audio output signals on line 22 may be PDM- or PWM-coded signals. The speaker assembly 30 converts the digital audio output signals to acoustical signals that will be heard by the operator.

The mobile phone 2 shown in FIG. 1 is not the only device in which the present invention is operable. The mobile phone 2 was selected for illustration purposes only, and the present invention contemplates many other devices besides mobile phones. Examples of other devices include, without limitation, portable phones, portable audio or video recording systems, hearing aids, personal digital assistants, wearable microphones (wired or wireless), and any other device which requires a microphone that is miniature in size and which requires a raw or formatted digital audio output.

Figure 2:
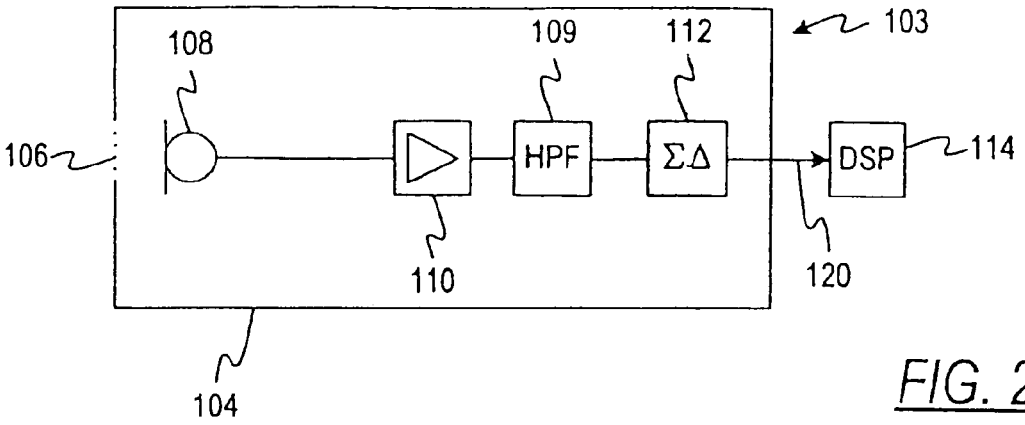
FIG. 2 is a functional diagram of a microphone assembly in accordance with a specific aspect of the present invention and pure digital DSP.

Turning now to FIG. 2, an alternative microphone assembly 103 according to the present invention includes a high-pass filter 109 connected between microphone pre-amplifier 110 and A/D converter 112, which preferably is a sigma-delta modulator. The high-pass filter 109 blocks DC components in the signals between microphone pre-amplifier 110 and A/D converter 112. The high-pass filter 109 also reduces the overall noise level in the microphone assembly 103 by filtering out low frequencies. An additional amplifier (not shown) may be connected between high-pass filter 109 and A/D converter 112. This additional amplifier may be a buffer or a differential converter, such as a single-entity differential converter.

A low-pass filter (not shown) may be connected between pre-amplifier 110 and A/D converter 112. This filter prevents undesired aliasing effects by limiting the frequency content of the signals before they are provided to A/D converter 112. High-pass filter 109 and low-pass filter are preferably incorporated into the microphone pre-amplifier 110 though, alternatively, high-pass filter 109 and low-pass filter may optionally be separate from the microphone pre-amplifier 110. The digital output signals on line 120 are raw signals in the sense that they have not been formatted according to any standard audio format. The raw digital output signals on line 120 are transmitted to the pure digital DSP 114 for further digital processing. Formatting of the digital output signals is discussed with reference to FIG. 4.

High-pass filter 109 typically comprises a capacitor and a resistor. The filtering effect of high-pass filter 109 is minimised by selecting capacitor and resistor values making $\tau$ as large as possible, or in other word, ensure a very low cut-off frequency of the high-pass filter. Furthermore, it is essential to minimise the noise from the high-pass filter itself. This may be achieved by selecting a large capacitance (e.g. 8 $\mu$F) since the electronic noise from a capacitor is given by kT/C, where C is the capacitance, T is the temperature and k Planck's constant. It is clear that the electronic noise from the capacitor increases with a smaller capacitance.

The characteristics of high-pass filter 109 may be designed by taking into consideration the design of the transducer receiving the acoustic signals. For example, by introducing a small pressure equalisation opening in the flexible diaphragm of the transducer, the cut-off frequency of the acoustic high-pass filter may be lowered down to e.g. 50 Hz. With such a low cut-off frequency, the high-pass filter may be designed with a smaller capacitor without increasing the total noise from the microphone. However, it is still necessary to remove frequencies below 200 Hz electronically so as to avoid overloading the microphone. For this reason high-pass filter 109 is typically designed with a cut-off frequency of around 200 Hz. Following this approach, the acoustic noise from the microphone is minimised. Noise leaking the acoustic high-pass filter may be filtered out by high-pass filter 109. Removal of the lower frequencies electronically using high-pass filter 109 results in a lower total noise and better matching of the low cut-off frequency.

The immediate result achieved following the above-mentioned design route is that the physical dimensions the capacitor may be significantly reduced which also means that the overall size of the microphone assembly may be reduced. This size issue is of specific importance in the area of hearing aids.

Figure 3:
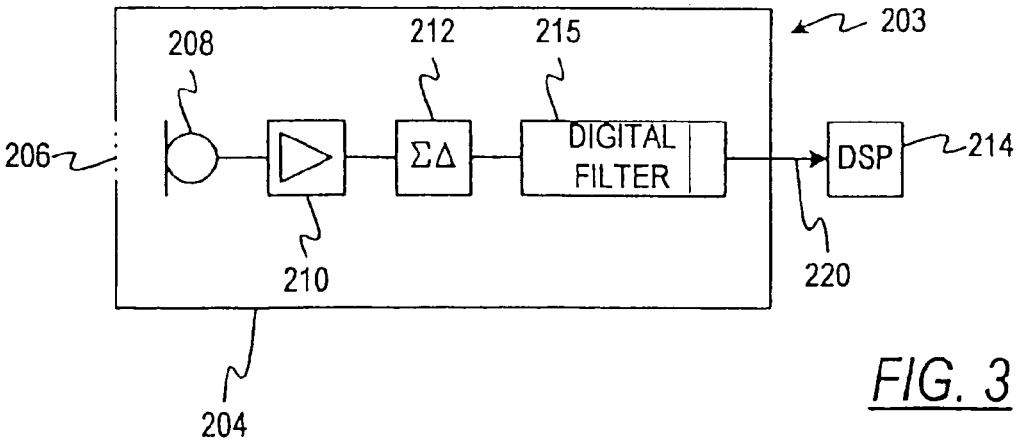
FIG. 3 is a functional diagram of a microphone assembly in accordance with another aspect of the present invention and pure digital DSP.

Turning now to FIG. 3, an alternative microphone assembly 203 includes a microphone casing 204 that includes transducer 208, a microphone pre-amplifier 210, an A/D converter 212, and a digital filter 215 in accordance with another embodiment of the present invention. The A/D converter 212 is preferably a sigma-delta modulator, and the microphone pre-amplifier 210 may optionally include either a high-pass filter or a low-pass filter or both, as discussed in connection with the embodiment described in FIG. 2. The digital filter 215 removes the high frequency noise from the digital bit stream. For example, the digital filter 215 is preferably a digital decimation low-pass filter, which removes out-of-band quantization noise. In the embodiment shown in FIG. 3, the digital filter 215 is shown within the microphone casing 204, but it is expressly contemplated that the digital filter 215 may be incorporated in a pure digital DSP 214 outside the microphone casing 204. Whether the digital filter 215 is incorporated in the A/D converter 212 or in the pure digital DSP 214 will depend on size constraints, for example.

Figure 4:
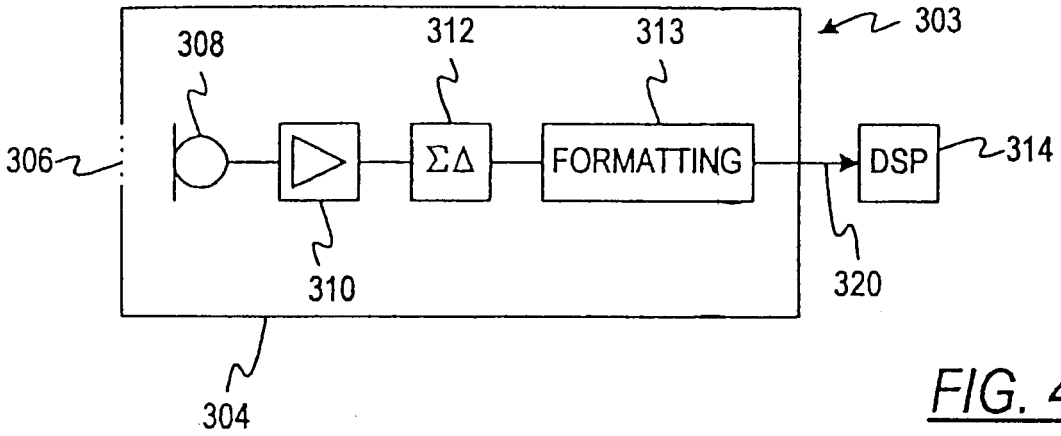
FIG. 4 is a functional diagram of a microphone assembly in accordance with yet another aspect of the present invention and pure digital DSP.

Next, FIG. 4 shows a microphone assembly 303 with a formatting circuit 313 connected between an A/D converter 312 and a pure digital DSP 314 in accordance with another embodiment of the present invention. The formatting circuit 313 formats the signals from the A/D converter 312 in accordance with a digital audio standard, such as, for example, S/PDIF, AES/EBU, $I^2S$, or any other suitable digital audio standard. Alternatively, the formatting may be performed by the pure digital DSP 314. The formatting circuit 313 is preferably incorporated into the A/D converter 312 within a microphone casing 304, and may further include a digital filter, like the one described in connection with FIG. 2. The pre-amplifier 310 may optionally include a high-pass filter and/or a low-pass filter like those described in connection with FIG. 2. The formatted digital output signals may be transmitted on line 320 to the pure digital DSP 314 for further processing or, because the digital output signals are formatted according to a digital audio standard, may be plugged into or incorporated directly into a device which is compliant with such digital audio standard, such as a portable audio or video device, for example.

Figure 5:
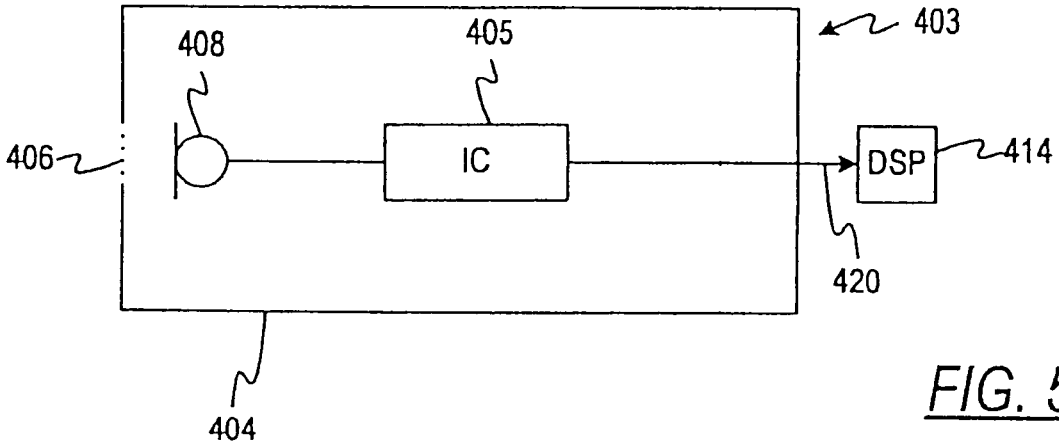
FIG. 5 is a functional diagram of a microphone assembly DSP in accordance with still another aspect of the present invention and pure digital.

Finally, FIG. 5 shows a microphone assembly 403 having an integrated circuit (IC) 405 connected between transducer 408 and a pure digital DSP 414. The IC 405 is located within a microphone assembly casing 404 and includes a microphone pre-amplifier 410 and an A/D converter 412, which is preferably a sigma-delta modulator. Depending on the application, the IC 405 may further include any one or combination of the following components: the high-pass filter 109, the low-pass filter, or the additional amplifier described in FIG. 2, the digital filter 215 described in FIG. 3, the formatting circuit 313 described in FIG. 4. Size constraints of the microphone may dictate how many additional components are incorporated on the IC 405. The analog audio signals from transducer 408 are provided to the IC 405 which outputs either raw or formatted digital output signals on line 420 to the pure digital DSP 414.

While the microphone assemblies 103, 203, 303, and 403, of FIGS. 2-5 have been described in connection with a pure digital DSP; each assembly can be used with a non-pure digital DSP having analog capabilities, as well.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

The invention claimed is:

1. A microphone assembly, comprising:

a microphone assembly casing having a sound inlet port;

a transducer for receiving acoustic waves through the sound inlet port, and for converting received acoustic waves to analog audio signals, said transducer being positioned within the microphone assembly casing; and an electronic circuit positioned within the microphone assembly casing, said electronic circuit includes a signal path defined by a cascade of, a pre-amplifier having an input and an output terminal, the input terminal being connected to the transducer so as to receive analog audio signals from the transducer, a sigma-delta modulator having an input and an output terminal, the input terminal being connected to the output terminal of the pre-amplifier so as to receive amplified analog audio signals from the pre-amplifier and to convert said amplified analog audio signals to digital audio signals, and a filter means connected between the pre-amplifier and the sigma-delta modulator, wherein, the filter means is a high pass filter, or a band pass filter including a high pass filter and a low pass filter, the microphone assembly casing is metallic, or includes a metallic layer so as to establish a Faraday cage, the pre-amplifier, the sigma-delta modulator and at least part of the filter means are integrated on a same chip to form a monolithic integrated circuit that is an application-specific integrated circuit (ASIC), and the microphone assembly is connected to a pure digital processor for further digital signal processing.

2. The microphone assembly according to claim 1, wherein the filter means is the high-pass filter.

3. A portable unit, comprising:

the microphone assembly according to claim 1.

4. The portable unit according to claim 3, wherein the portable unit is selected from the group consisting of hearing aids, assistive listening devices, mobile recording units, MP3 players, mobile communication units, mobile phones and cellular phones.

5. The microphone assembly according to claim 1, wherein the filter means is the band-pass filter including a high pass filter and a low pass filter.

6. The microphone assembly according to claim 1, wherein the filter means in the signal path prevents low frequency components from reaching the sigma-delta modulator.

7. The microphone assembly according to claim 1, further comprising:

an amplifier in the signal path between the filter means and the sigma-delta modulator so as to amplify the filtered analog audio signals.

8. The microphone assembly according to claim 7, wherein the amplifier forms part of the monolithic integrated circuit.

* * * * *